US008595867B1

(12) United States Patent
Zinna

(10) Patent No.: US 8,595,867 B1
(45) Date of Patent: Dec. 3, 2013

(54) HYBRID RACE IDENTIFICATION NUMBER BELT AND BIB-ATTACHMENT METHOD

(76) Inventor: Leonard Charles Zinna, Escondido, CA (US)

( * ) Notice: Subject to any disclaimer, the term of this patent is extended or adjusted under 35 U.S.C. 154(b) by 314 days.

(21) Appl. No.: 12/932,373

(22) Filed: Feb. 24, 2011

Related U.S. Application Data

(60) Provisional application No. 61/339,549, filed on Mar. 5, 2010.

(51) Int. Cl.
*A41D 27/08* (2006.01)

(52) U.S. Cl.
USPC ..... 2/244; 2/338

(58) Field of Classification Search
USPC ..... 2/244, 338, 339, 342, 336, 337, 324, 2/311, 312, 316, 317, 318, 319, 315; 24/3.1, 578.1, 578.15
See application file for complete search history.

(56) References Cited

U.S. PATENT DOCUMENTS 1,436,854 A * 11/1922 Brady ..... 40/586
3,848,270 A * 11/1974 Rand ..... 2/311
4,137,660 A * 2/1979 Dettmann et al. ..... 40/303
4,625,337 A * 12/1986 Zahn ..... 2/82
4,947,489 A * 8/1990 Greenwood ..... 2/304
4,975,987 A * 12/1990 Teachout et al. ..... 2/246
5,299,324 A 4/1994 Zinna
5,581,815 A * 12/1996 Hans ..... 2/244
5,813,051 A * 9/1998 Counter ..... 2/69
5,836,017 A * 11/1998 Hironaga et al. ..... 2/69
5,852,829 A * 12/1998 Relaford ..... 2/338
5,987,650 A * 11/1999 Carroll ..... 2/244
6,026,515 A * 2/2000 Nielson et al. ..... 2/244
6,076,194 A * 6/2000 Purkett ..... 2/279
6,098,202 A * 8/2000 Peck ..... 2/244
6,279,804 B1 * 8/2001 Gregg ..... 224/675
6,308,338 B1 * 10/2001 Caldwell ..... 2/312
6,367,088 B1 * 4/2002 Bergemann ..... 2/244
6,389,605 B2 * 5/2002 Srivastava ..... 2/312
6,408,444 B1 6/2002 Zinna
6,836,899 B1 * 1/2005 Glasmire ..... 2/52
7,302,712 B2 * 12/2007 Abrusia et al. ..... 2/239
7,320,421 B2 * 1/2008 Guminski ..... 224/268
7,725,954 B2 * 6/2010 DelPrete et al. ..... 2/69.5
7,819,721 B1 * 10/2010 Messier ..... 450/86
2001/0046661 A1 * 11/2001 Shorter ..... 434/395
2002/0029407 A1 * 3/2002 Blechman ..... 2/311
2004/0244152 A1 * 12/2004 Place ..... 24/3.1
2004/0255431 A1 * 12/2004 Cooke et al. ..... 24/3.1
2005/0155138 A1 * 7/2005 Zic-Hock et al. ..... 2/244
2005/0229329 A1 * 10/2005 Miller ..... 8/158
2006/0272076 A1 * 12/2006 Schroeder ..... 2/336

(Continued)

*Primary Examiner* — Alissa L Hoey
(74) *Attorney, Agent, or Firm* — Loyal McKinley Hanson

(57) ABSTRACT

A method for attaching a race-number bib having two spaced-apart holes to a race-number belt having a belt component with two spaced-apart snap-fastener subassemblies includes the step of providing two retrofitting cord-fastener assemblies such that each cord-fastener assembly has a cord with a mating snap-fastener subassembly on its proximal end. The method proceeds by snapping (i.e., attaching) the two mating snap-fastener subassemblies into engagement of the two snap-fastener subassemblies on the belt component, threading the distal ends of the cords through the holes in the race-number bib, and placing locking components onto the cords to secure the bib. A race-number belt constructed according to another aspect of the invention includes both snap-fastener assemblies and bib-attaching cords, with the proximal ends of the cords secured by the snap-fastener assemblies.

4 Claims, 6 Drawing Sheets

(56) References Cited

U.S. PATENT DOCUMENTS

| | | | | |
|---|---|---|---|---|
| 2007/0294806 | A1* | 12/2007 | Harazi | 2/244 |
| 2008/0190980 | A1* | 8/2008 | Overton | 224/664 |
| 2010/0011623 | A1* | 1/2010 | Seckler et al. | 36/136 |
| 2010/0257658 | A1* | 10/2010 | Schwietz-Flauto | 2/207 |
| 2010/0306902 | A1* | 12/2010 | Bourque | 2/244 |
| 2012/0216326 | A1* | 8/2012 | Van Kuren et al. | 2/69 |
| 2012/0297647 | A1* | 11/2012 | Whigham | 36/136 |
| 2013/0019381 | A1* | 1/2013 | Lovell | 2/245 |
| 2013/0025027 | A1* | 1/2013 | Spence | 2/227 |

* cited by examiner

HYBRID RACE IDENTIFICATION NUMBER BELT AND BIB-ATTACHMENT METHOD

CROSS REFERENCE TO RELATED APPLICATION

This application claims the benefit of U.S. Provisional Patent Application Ser. No. 61/339,549 filed Mar. 5, 2010.

BACKGROUND OF THE INVENTION

1. Technical Field

This invention relates generally to the field of athletic equipment, and more particularly to race identification number belts of the type commonly worn by runners and other athletes to hold race-number bibs during running competitions and other events.

2. Description of Related Art

Instead of using safety pins to attach a race-number bib to their clothing, many athletes prefer to use a race-number belt. A typical race-number bib includes an 8-inch by 6-inch sheet of paper on which a race identification number appears, while a typical race-number belt includes a woven-elastic belt with bib-attaching components on it. The athlete buckles the belt around their waist, adjusts the buckle to size the belt for their waist, unbuckles and removes the belt, and then manipulates the bib-attaching components in order to attach the bib. With the bib attached to the belt, the athlete can quickly and conveniently don and remove the combination of the belt and bib when desired while avoiding various disadvantages of safety pins.

Various existing race-number belts use different bib-attaching arrangements designed to accommodate the differing preferences of users. U.S. Pat. No. 5,299,324 describes one such belt. It includes two ⅛-inch by 3-inch elastic pieces that are also referred to herein as "elastic cords." Each elastic cord has a proximal end that is stitched to a one-inch woven elastic belt so that the elastic cords are thereby held on the belt in spaced-apart locations. The athlete threads the free distal ends of the elastic cords through two existing quarter-inch diameter mounting holes spaced apart about 6⅞ inches on the upper portion of the race-number bib and then secures the bib in place on the belt by sliding mini cord locks onto the elastic cords.

Many athletes prefer such "cord-fastener attachments," although others prefer the race-number belt described in U.S. Pat. No. 6,408,444. It describes a race-number belt having two snap-fastener assemblies instead of elastic cords (i.e., "snap-fastener attachments"). Each snap-fastener assembly includes two snap-fastener subassemblies that snap together in the usual manner of snap fasteners, but with the bib held in between. They are subsequently referred to as a first stud-receiving socket subassembly (a female component) that receives and engages a second socket-mating stud subassembly (a male component). The athlete places the bib against the stud-receiving socket component of each of two first subassemblies on the belt, and then forces the socket-mating stud component of each of two second subassemblies through the bib and into engagement of a respective one of the socket components, with the bib crushed in between and thereby secured in place on the race-number belt.

Both belt types are popular. The problem is that a cord-fastener belt providing cord-fastener attachments does not accommodate athletes preferring a snap-fastener belt having snap-fastener attachments, and vice versa. Thus, there is a need to overcome this problem.

SUMMARY OF THE INVENTION

In view of the foregoing, it is a primary object of the present invention to alleviate the concern outlined above by providing a way to facilitate both cord-fastener attachment and snap-fastener attachment of a race-number bib to a race-number belt so that the athlete is free to choose the attachment method preferred. The present invention achieves this objective by providing retrofitting cord-fastener assemblies having cords with mating snap-fastener subassemblies on their proximal ends that snap into engagement of the existing snap-fastener subassemblies on a snap-fastener belt; an athlete can use their race-number belt either way. In addition, another aspect of the invention provides a dual-use belt (also referred to as a hybrid race-number belt) that has both snap fasteners and cord fasteners, with a proximal end of each of two bib-attaching cords secured to the belt during belt fabrication by one of the two snap-fastener assemblies on the belt; an athlete can use this belt either way also.

To paraphrase some of the more precise language appearing in the claims and further introduce the nomenclature used, the invention includes a method for cord-fastener attachment of a race-number bib to a snap-fastener type of race-number belt. The race-number bib has two spaced-apart mounting holes for use in attaching it to the race-number belt, and the belt has two spaced-apart snap-fastener subassemblies. The method of the present invention provides two cords having proximal ends on which are mounted two snap-fastener sub assemblies that mate with the two snap-fastener subassemblies on the belt. An athlete snaps them into engagement of the snap-fastener subassemblies on the belt, leaving the distal ends of the cords free so that they can be threaded through the holes in the bib as cord-fastener attachments.

In other words, the method includes the step of providing two retrofitting cord-fastener assemblies, each having a cord and a mating snap-fastener subassembly on a proximal end of the cord that mates with a snap-fastener subassembly on the race-number belt (e.g., a male component in the form of a socket-mating stud subassembly). The method proceeds by snapping the mating snap-fastener subassemblies on the cords into engagement of the snap-fastener subassemblies on the race-number belt in order to thereby secure the first and second cords to the race-number belt. The athlete then threads the distal ends of the cords through the two mounting holes of the race-number bib and places mini cord-locking components onto the cords in order to secure the race-number bib on the cords.

In line with the foregoing, the invention provides a snap-fastener type of race-number belt accompanied by two retrofitting cord-fastener assemblies (items detached from, but attachable to, the belt). The athlete snaps the cord-fastener assemblies into engagement of snap-fastener subassemblies on the belt as a bib-attachment option. In addition, the invention provides separate retrofitting cord-fastener assemblies that an athlete can purchase separately for the athlete's use with an existing snap-fastener type of belt in order to retrofit the existing snap-fastener belt for cord-fastener attachment. Beyond all that, there is provided a dual-use race-number belt having both snap-fastener assemblies and bib-attaching cords on the belt component. During belt fabrication, components of two snap-fastener subassemblies are pressed together onto the belt component with the proximal ends of two bib-attaching cords held in between in order to thereby secure the proximal ends to the belt; the athlete can choose either snap-fastener attachment or cord-fastener attachment.

Thus, the invention better accommodates the differing preferences of athletes with a bib-attachment method and related race-number belt structure. In addition, the hybrid combination has an impact at the retailer level in that retailers no longer need to stock two types of race-number belts to accommodate both athlete and retainer preferences. The following detailed description and accompanying illustrative drawings make the foregoing and other objects, features, and advantages of the invention more apparent.

DESCRIPTION OF THE PREFERRED EMBODIMENTS

Nomenclature.

Figure 1:
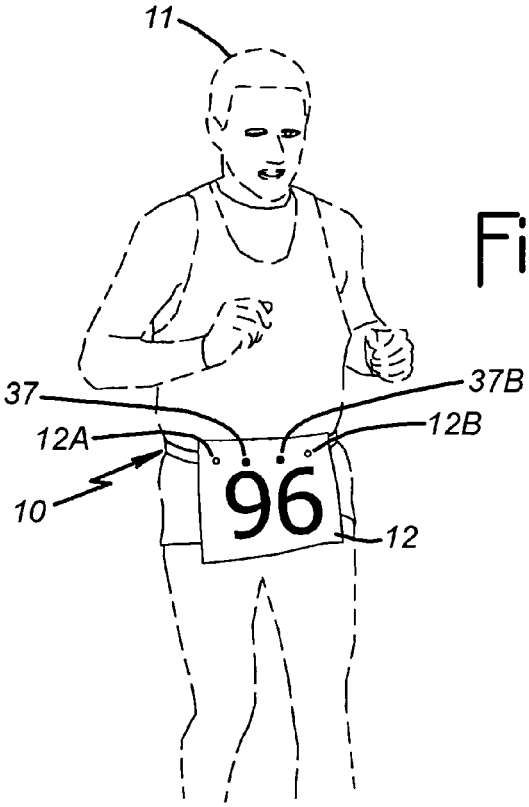
FIG. 1 of the drawings is a pictorial of an athlete wearing a race-number bib on a race-number belt constructed according to the invention.
Figure 2:
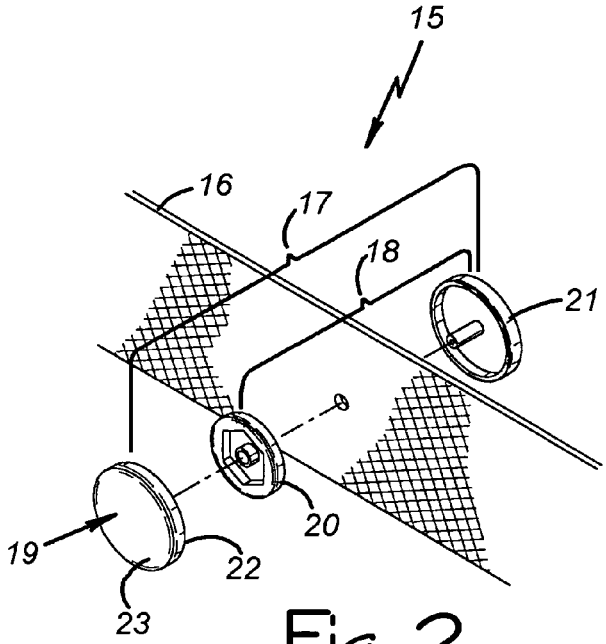
Fig. 2 PRIOR ART
FIG. 2 of the drawings is an enlarged exploded view of a snap-fastener assembly on a race-number belt constructed according to the prior art.
Figure 3:
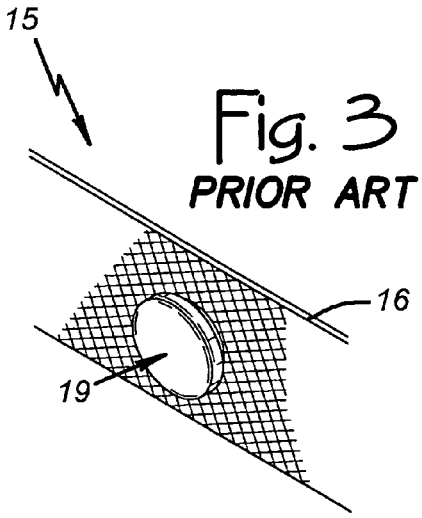
Fig. 3 PRIOR ART
FIG. 3 is an assembled view of the prior art snap-fastener assembly.

FIG. 1 of the drawings shows a dual-use race-number belt 10 constructed according to the invention. It is illustrated in use by an athlete 11 to hold a race-number bib 12 on the athlete during a race or other competitive event. The race-number belt 10 has some features similar to the belts described in U.S. Pat. Nos. 5,299,324 and 6,408,444. Those patents are hereby incorporated herein for all the details they provide.

First consider the prior art race-number belt 15 that is illustrated in FIGS. 2, 3, 4, and 5 as a step in developing the nomenclature used in describing the present invention. The race-number belt 15 is described more fully in the second patent referenced above (i.e., U.S. Pat. No. 6,408,444). It includes a belt component 16 (e.g., a one-inch wide length of elastic) on which a buckle (not shown) is installed, along with two snap-fastener assemblies. Just a first snap-fastener assembly 17 is illustrated (identified in FIG. 2) for illustrative convenience because the second snap-fastener is basically the same. The first snap-fastener assembly 17 is a typical, commercially available type of snap-fastener assembly (e.g., plastic composition) having a first snap-fastener subassembly in the form of a stud-receiving socket subassembly 18 and a mating second snap-fastener subassembly in the form of a socket-mating stud subassembly 19. In use, an athlete snaps the socket-mating stud subassembly 19 into removable engagement of the stud-receiving socket subassembly 18 by pressing the two together in a known way. The athlete removes the socket-mating stud subassembly 19 by prying it back out (e.g., with thumb and index finger).

Figure 4:
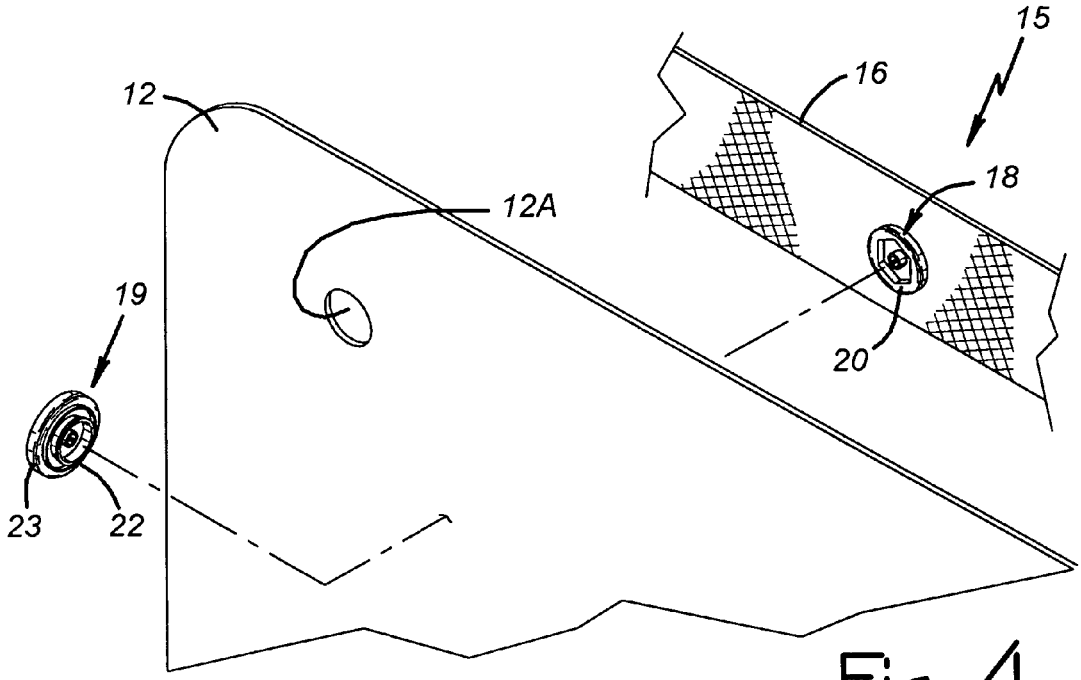
Fig. 4 PRIOR ART
FIG. 4 is an exploded view of the prior art snap-fastener assembly in position to be applied to the race-number bib by crushing the bib between the first and second subassemblies of the snap-fastener assembly.
Figure 5:
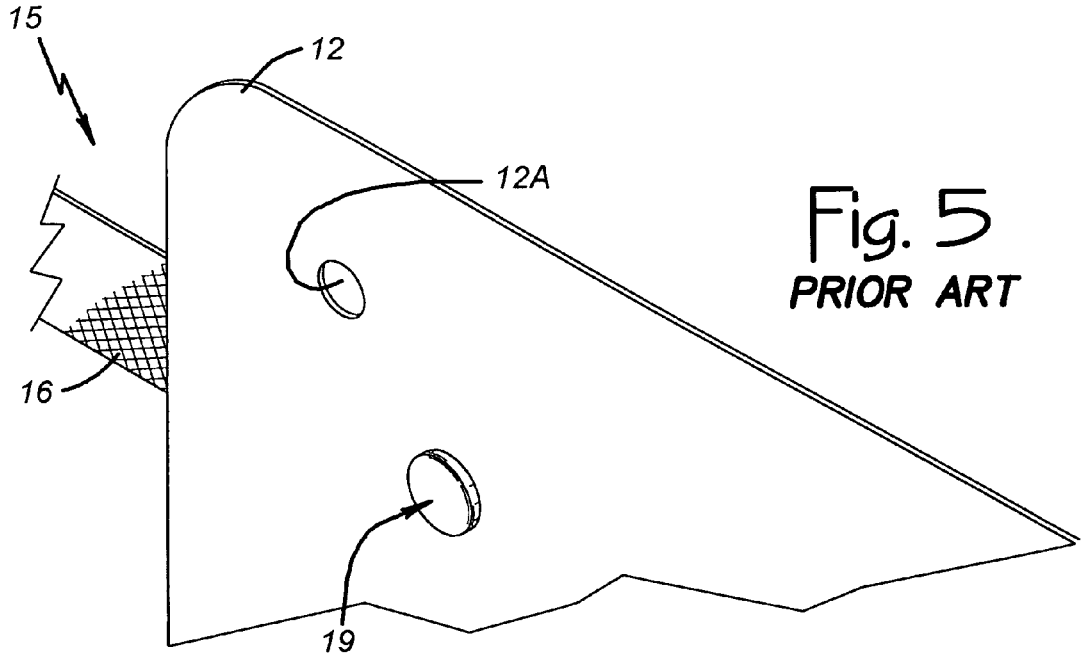
Fig. 5 PRIOR ART
FIG. 5 shows the prior art snap-fastener assembly with the first and second subassemblies snapped together in order to thereby secure the bib to the race-number belt.

The stud-receiving socket subassembly 18 includes a stud-receiving socket component 20 (FIGS. 2 and 4) and a first cap component 21 (FIG. 2), while the socket-mating stud subassembly 19 includes a socket-mating stud component 22 and a second cap component 23 (FIG. 4). Those components are assembled in a known way (e.g., pressed together with a snap-fastener assembly tool). When the snap-fastener assembly 17 is fully assembled on the belt component 16, the first cap component 21 extends through the belt component 16 where it has been pressed into engagement of the socket component 20 to form the stud-receiving socket subassembly 18 as it appears in FIG. 4 (referred to generally in the claims as a snap-fastener subassembly). In addition, the second cap component 23 has been pressed into engagement of the socket-mating stud component 22 to form the socket-mating stud subassembly 19 as it appears in FIG. 4 (referred to generally in the claims as an original mating snap-fastener subassembly). The socket-mating stud subassembly 19 thereby formed is snapped onto the stud-receiving socket subassembly 18 to result in the configuration shown in FIG. 3.

The stud-receiving socket subassembly 18 works in a known way by removably receiving the socket-mating stud sub assembly 19 in snapping engagement. Together, they form the snap-fastener assembly 17. To attach the race-number bib 12 to the prior art race-number belt 15 using the snap-fastener assembly 17, the athlete proceeds without using the quarter-inch holes 12A and 12B provided in the bib 12. Instead, the athlete lays the belt 16 on a hard surface, such as a table top, with the receiving snap subassemblies facing upward, places the race-number bib over the receiving snap subassemblies, makes an indent in the bib over both receiving snap subassemblies (e.g., pressing against the bib with the thumb), and the snaps the mating snap subassemblies into engagement of the receiving snap subassemblies while crushing the bib in between. Doing so results in the configuration shown in FIG. 5.

As an idea of size, the stud-receiving socket component 20 may measure about 7/16 inch in outside diameter, for example, with the first cap component 21 measuring about 0.5 inch in outside diameter. The components of the socket-mating stud subassembly 19 are similarly sized. Of course, those dimensions may vary significantly depending on the snap-fastener that is used.

Dual-Use Belt.

Figure 6:
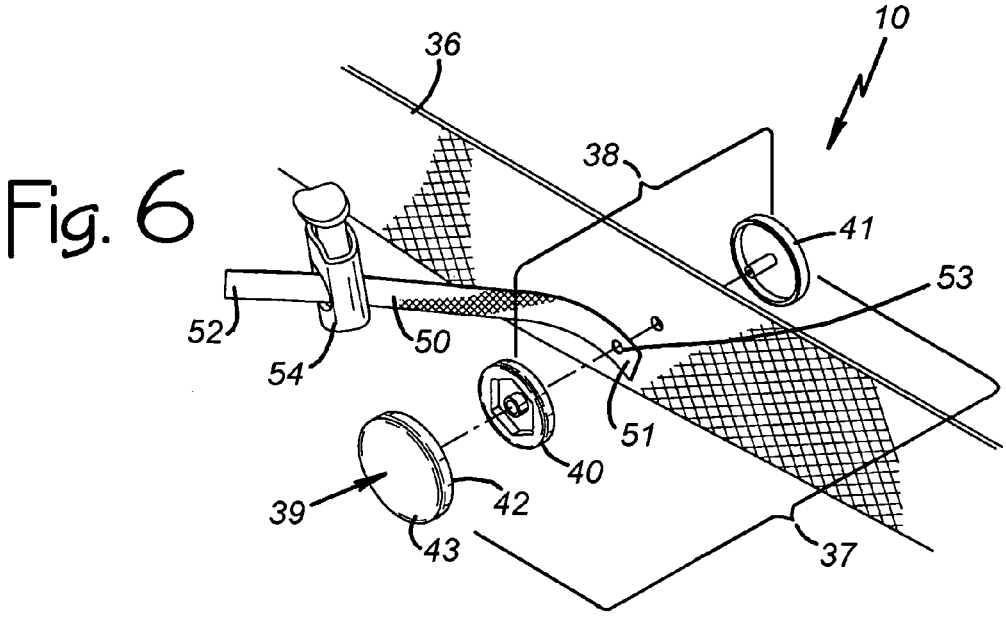
FIG. 6 is an exploded view similar to FIG. 2 of a combination of a snap-fastener assembly and a cord-fastener assembly on a dual-use race-number belt constructed according to the present invention.
Figure 7:
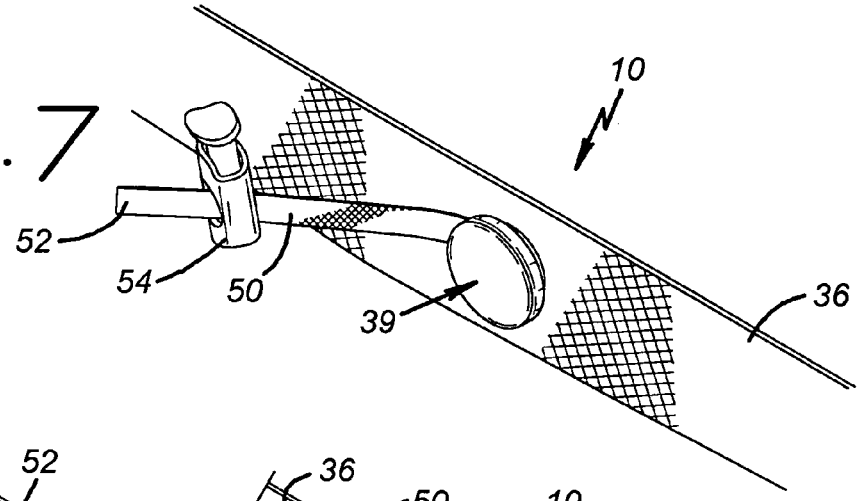
FIG. 7 is an assembled view of the combination of the snap-fastener assembly and the cord-fastener assembly.

Now consider FIGS. 6 and 7. They show various details of the race-number belt 10 that was first introduced above with reference to FIG. 1. The race-number belt 10 is similar in many respects to the race-number belt 15 described above and so only the major differences are described in further detail. For convenience, reference numerals identifying parts of the race-number belt 10 are increased by twenty over those describing similar, related, and/or associated parts of the race-number belt 15.

With the above-mentioned numbering scheme in mind, notice that the race-number belt 10 includes a one-inch wide woven elastic belt component 36 (similar to the belt component 16) on which is mounted a first snap-fastener assembly 37 (FIG. 6) that is similar to the snap-fastener assembly 17 described above. There are, of course, two identical snap-fastener assemblies on the belt component 36, with center-to-center spacing of about 5½ inches, but only the first snap-fastener assembly 37 is shown in FIG. 6 for illustrative convenience. A second snap-fastener assembly 37B is identified in FIG. 1. In terms of the claim language presented later on, the first snap fastener assembly functions as first means for attaching the race-number bib 12 to the belt component 36 (i.e., a first snap-fastener attachment), while the second snap fastener assembly functions as second means for attaching the race-number bib 12 to the belt component 36 (i.e., a second snap-fastener attachment).

The first snap-fastener assembly 37 includes a first snap-fastener subassembly 38 and a second snap-fastener subassembly 39 that snap together removably in the well-known manner of a snap-fastener device (like the subassemblies 18 and 19 described previously). The illustrated first snap-fastener subassembly 38 is a female component (i.e., a stud-receiving socket subassembly) and the illustrated second snap-fastener subassembly 39 is a male component (i.e., a socket-mating stud subassembly). That is a preferable arrangement. A race-number belt constructed according to the present invention can, instead, have a first snap-fastener subassembly that is a male component and a second snap-fastener assembly that is a female component.

With further regard to the illustrated first snap-fastener assembly 37, the first subassembly 38 includes a stud-receiving socket component 40 and a first cap component 41 that a belt-fabricator presses together in order to mount the first snap-fastener subassembly 38 on the belt component 36. The second subassembly 39 includes a socket-mating stud component 42 and a second cap component 43 pressed onto the stud component 42. So assembled, the second subassembly 39 can be snapped removably into engagement of the first subassembly 38 for snap-fastener attachment of the race-number bib 12 in the manner of the prior art.

According to a major aspect of the present invention, the race-number belt 10 also includes means for cord-fastener attachment of the race-number bib 12 to the belt component 36. To accomplish this, the race-number belt 10 includes two cords (e.g., about ⅛-inch to ¼-inch wide by about 3-inch long elastic bands) that are held on the belt component 36 by the first and second snap-fastener assemblies where they function as third and fourth means for attaching the race-number bib 12 to the belt component 36. The two cords are identical and so only a first cord 50 is illustrated in FIGS. 6 and 7. The first cord includes a proximal end 51, a distal end 52, and a hole 53 in the proximal end 51. The first cap component 41 of the first snap-fastener subassembly 38 passes through the hole 53, with the proximal end 51 of the cord 50 thereby secured intermediate the first cap component 41 and the first stud-receiving socket component 40 on a socket-component side of the belt component 36 (FIG. 6). In addition, two cord-locking components are provided for use in securing the race-number bib 12 with the two cords, only a first cord-locking component 54 being illustrated in the drawings (FIGS. 6 and 7).

Figure 8:
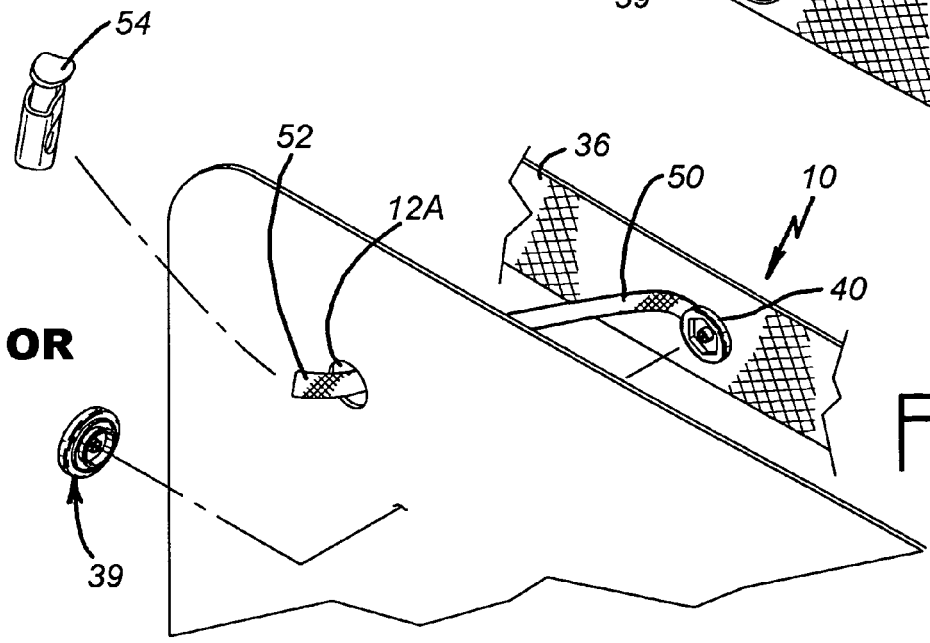
FIG. 8 is a diagrammatic representation of the race-number belt illustrated in FIGS. 6 and 7, showing two alternatives for attaching the race-number bib.

FIG. 8 illustrates the two bib-attachment options. The athlete can use the cord-fastener attachment option by first threading the distal end of the cord 50 through one of the two holes in the race-number bib 12 and then securing the bib 12 in place using the cord-locking component 54. Alternatively, the athlete can use the snap-fastener attachment option by first removing the second subassembly 39 from engagement with the first subassembly 38 (and removing its counterpart of the second snap-fastener assembly), positioning the bib 12 over the receiving snap subassemblies, and then snapping the second snap subassemblies into engagement of the receiving snap subassemblies with the bib secured intermediate the first and second subassemblies.

Retrofitting Cord-Fastener Assembly.

Figure 9:
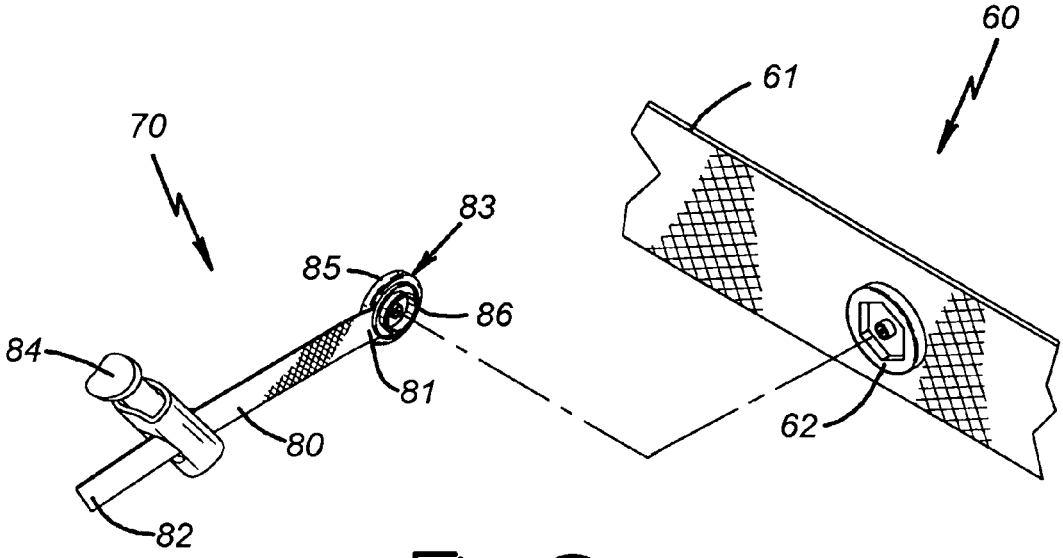
FIG. 9 is an exploded view of a retrofitting cord-fastener assembly constructed according to the invention for attaching the race-number bib to the prior art race-number belt illustrated in FIGS. 2, 3, 4, and 5.
Figure 10:
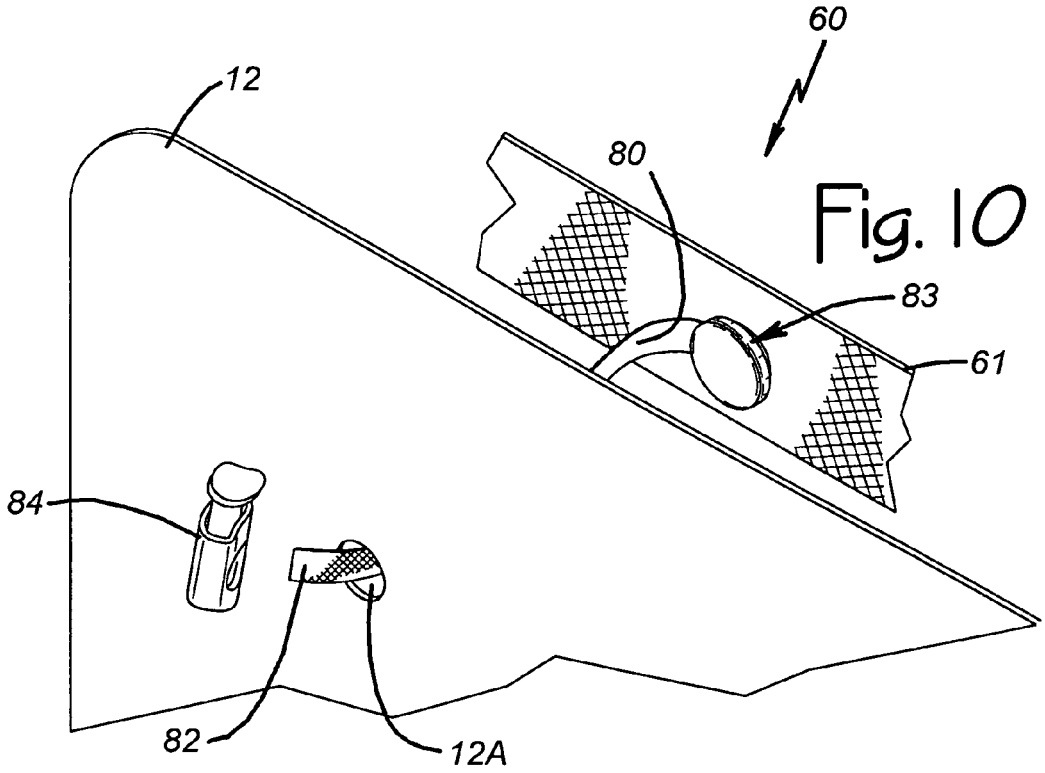
FIG. 10 is a diagrammatic representation of the retrofitting cord-fastener assembly and the prior art race-number belt, with a socket-mating stud subassembly on the proximal end of the cord shown snapped into the stud-receiving socket subassembly on the prior art race-number belt and the distal end of the cord threaded through a hole in the race-number bib in preparation for adding the cord-locking component.
Figure 11:
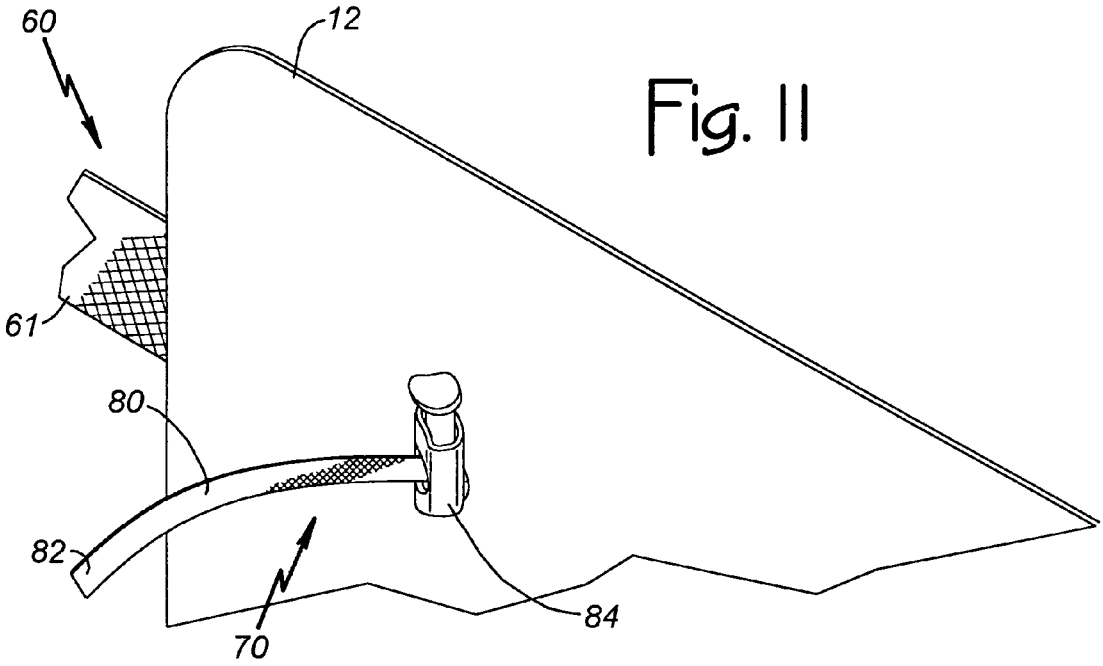
FIG. 11 shows the cord-locking component in place on the cord and in position to secure the race-number bib on the prior art race-number belt.

Turning now to FIGS. 9, 10, and 11, they show various aspects of a race-number belt 60 constructed according to another aspect of the invention to provide a cord-fastener option. The race-number belt 60 includes two identical snap-fastener assemblies on a belt component 61, together with two separate cord-fastener assemblies that snap into engagement of the two snap-fastener assemblies in order to thereby provide the cord-fastener attachment option. Apart from the separate cord-fastener assemblies, the race-number belt 60 is similar to the prior art race-number belt component 15 discussed previously with reference to FIGS. 2-5. Only a stud-receiving component 62 of the first snap-fastener assembly is shown in FIG. 9.

The two cord-fastener assemblies are identical and so only a first cord assembly 70 is shown and described. It includes a cord 80 (FIG. 9) having a proximal end 81 and a distal end 82 (e.g., a ⅛-inch to ¼-inch wide and 3-inch long elastic band). A snap-fastener subassembly 83 is mounted on the proximal end 81 and a cord-locking component 84 is included on the cord 80. A snap-fastener cap component 85 and a snap-fastener socket-mating stud component 86 are pressed together with a snap assembly tool to form the snap-fastener subassembly 83, with the proximal end of the cord 80 secured in between the components 85 and 86. The snap-fastener subassembly 83 is similar to the subassembly 39 described above with reference to FIGS. 6, 7, and 8 in that the socket-mating stud component 86 mates with the stud-receiving component 62 on the belt 61 so that the athlete can snap the snap-fastener subassembly 83 into engagement of the stud-receiving component 62 in order to thereby secure the proximal end 81 of the cord 80 on the belt component 61. The athlete first removes an original snap-fastener subassembly part of the race-number belt 60 (not shown) from the stud-receiving component 61 (e.g., a subassembly like the subassembly 19 on the race-number belt 15), and then attaches the snap-fastener subassembly 83. A second one of the two cord-fastener assemblies is secured to the belt component 61 in much the same way.

With the two cord-fastener assemblies (i.e. first assembly 83 and its identical second assembly counterpart) secured to the belt component 61 in the manner described above, the athlete attaches the race-number bib 12 to the belt 61 using the cord-fastener assemblies. For the first cord-fastener assembly 70, the athlete threads the distal end 82 of the cord 80 through the hole 24 in the bib 12 as illustrated in FIG. 10. Then, the athlete places the cord-locking component 84 over the distal end 82 and onto the cord 80, thereafter sliding the cord-locking component 84 along the cord 80 until it presses the bib 12 to the belt component 61. That secures the bib 12 to the belt component 61 in the configuration shown in FIG. 11. The second one of the two cord-fastener assemblies is used in much the same way. A cord fastener assembly constructed as described above may be a separate, unattached part of a belt constructed according to the invention, or it may be an entirely separate item that an athlete purchases for use with an existing snap-fastener type of race-number belt.

Retrofitting Methodology.

Figure 12:
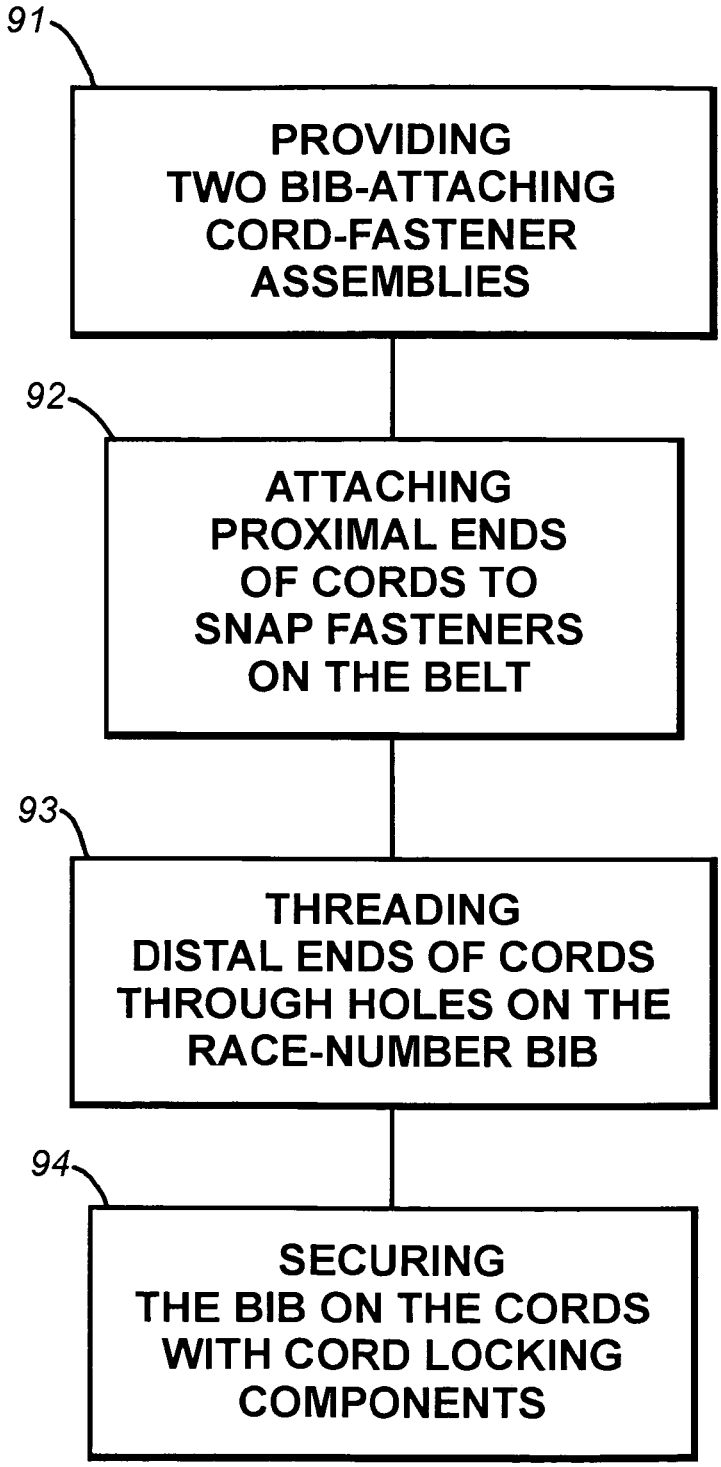
FIG. 12 is a block diagram of the methodology of the present invention.

FIG. 12 provides a block diagram of the methodology of the present invention. As indicated by a first block 91, the method includes the steps of providing two bib-attaching cord-fastener assemblies. This includes providing a first cord assembly (e.g., the cord assembly 70) having a first cord and a first mating snap-fastener subassembly on a proximal end of the first cord that mates with the first snap-fastener subassembly on the belt component, and providing a second cord assembly (e.g., identical to the first cord assembly) having a second cord and a second mating snap-fastener subassembly on a proximal end of the second cord that mates with the second snap-fastener subassembly on the belt component.

The method proceeds, as indicated by a second block 92 in FIG. 12, by attaching proximal ends of the cords to snap fasteners on the belt. In other words, it proceeds by snapping the first mating snap-fastener subassembly into engagement of the first snap-fastener subassembly on the belt component, and the second mating snap-fastener subassembly into engagement of the second snap-fastener subassembly on the belt component in order to thereby secure the first and second cords to the belt component of the race-number belt. As indicated by a third block 93, the method includes threading the distal ends of the cords through holes on the race-number bib. In other words, it includes threading the distal end of the first cord through a first one of the two mounting holes of the race-number bib and the distal end of the second cord through a second one of the two mounting holes. After that, the method continues, as indicated by a fourth block 94, by securing the bib on the cords with cord locking components. That is to say, by placing a first locking component onto the first cord and a second locking component onto the second cord in order to thereby secure the race-number bib on the first and second cords.

As mentioned previously, male and female components may be used in different positions. Preferably, the first and second snap-fastener assemblies on the belt component are female snap-fastener subassemblies (i.e., they have stud-receiving socket components). In that case, the step of providing a first cord assembly includes providing a first cord assembly having a first mating snap-fastener subassembly on the proximal end of the first cord that is a first male snap-fastener subassembly (i.e., it includes a socket-mating stud component). Similarly, the step of providing a second cord assembly includes proving a second cord assembly having a second mating snap-fastener subassembly on the proximal end of the second cord that is a second male snap-fastener subassembly. As a result, the first and second mating snap-fastener subassemblies on the first and second cords mate with the female snap-fastener subassemblies on the belt component.

Thus, the invention provides a bib-attachment method and related race-number belt structure that facilitate both cord-fastener attachment and snap-fastener attachment of a race-number bib to a race-number belt in different ways so that the athlete is free to choose the attachment method preferred. The athlete has the option of using a prior art snap-fastener belt, the option of using either cord-fastener attachment or snap-fastener attachment with a dual-use belt, and the option of using cord-fastener attachment by retrofitting an existing snap-fastener belt with cord-fastener assemblies. From the foregoing and descriptions, one of ordinary skill in the art can readily practice the methodology and implement the structure of the present invention. Although exemplary embodiments have been shown and described, one of ordinary skill in the art may also make many changes, modifications, and substitutions without necessarily departing from the spirit and scope of the invention. For example, the first and second cords can be composed of non-elastic material, including shoe-string like material, and be round rather than flat. In addition, the placement of male and female components can be interchanged within the broader inventive concepts, installing a subassembly 19 on the belt and having the subassembly 18 free, for example, or installing a stud-receiving component 62 on a cord fastener assembly similar to the cord-fastener assembly 80 instead of the snap-fastener subassembly 83. All such variations are contemplated and the claims should be interpreted to cover them. As for the specific terminology used to describe the exemplary embodiments, it is not intended to limit the invention; each specific term is intended to include all technical equivalents that operate in a similar manner to accomplish a similar purpose or function.

What is claimed is:

1. A race-number belt for holding a race-number bib having two mounting holes, comprising:

a belt component;

first means for attaching the race-number bib to the belt component, said first means including a first snap-fastener subassembly mounted on the belt component;

second means for attaching the race-number bib to the belt component, said second means including a second snap-fastener subassembly mounted on the belt component;

third means for attaching the race-number bib to the belt component, said third means including a first cord assembly having a first cord with a proximal end that is secured to the belt component by the first snap-fastener subassembly, a free distal end that is not stitched to the belt, and a cord-locking component that a user can slide onto the free distal end of the cord and along the cord to a selected position on the cord for bib-retention purposes; and fourth means for attaching the race-number bib to the belt component, said fourth means including a second cord assembly having a second cord with a proximal end that is secured to the belt component by the second snap-fastener subassembly, a free distal end that is not stitched to the belt, and a cord-locking component that a user can slide onto the free distal end of the cord and along the cord to a selected position on the cord for bib-retention purposes.

2. A race-number belt as recited in claim 1, wherein the first and second cords are elastic bands.

3. A race-number belt as recited in claim 1, wherein:

the proximal end of the first cord is held between a first cap component and a first socket component of the first snap-fastener subassembly; and the proximal end of the second cord is held between a second cap component and a second socket component of the second snap-fastener subassembly.

4. A race-number belt with a belt component for holding a race-number bib having two mounting holes, comprising:

two spaced-apart snap-fastener subassemblies on belt component, including a first snap-fastener subassembly and a second snap-fastener subassembly;

first means for attaching the race-number bib to the first snap-fastener subassembly on the belt component, including a first cord assembly having a first cord with a proximal end and a distal end, a first locking component on the first cord intermediate the proximal and distal ends, and a first mating snap-fastener subassembly on the proximal end of the first cord that mates with the first snap-fastener subassembly on the belt component; and second means for attaching the race-number bib to the second snap-fastener subassembly on the belt component, including a second cord assembly having a second cord with a proximal end and a distal end, a second locking component on the second cord intermediate the proximal and distal ends, and a second mating snap-fastener subassembly on the proximal end of the second cord that mates with the second snap-fastener subassembly on the belt component;

wherein the first and second locking components are cord-locking components that a user can slide onto and along the first and second cords to selected positions for bib-retention purposes;

wherein the distal ends of the first and second cords are not stitched to the belt component in order to enable threading of the distal ends of the first and second cords through the two mounting holes in the race-number bib and to enable a user to slide the cord-locking components onto the distal ends of the first and second cords:

whereby an athlete can snap the first and second mating snap-fastener subassemblies into engagement of the first and second stud-receiving socket components on the belt component, remove the first and second locking components, thread the distal ends of the first and second cords through the two mounting holes of the race-number bib, and then place the first and second locking components back onto the first and second cords to thereby attach the race-number bib to the race-number belt.

* * * * *